US005161964A

United States Patent [19]

Frigiere et al.

[11] Patent Number: 5,161,964

[45] Date of Patent: Nov. 10, 1992

[54] CATALYTIC BURNER

[75] Inventors: Rene Frigiere, Charbonniere les Bains; Philippe Bottazzi, Rillieux la Pape, both of France

[73] Assignee: (Societe Anonyme) Cricket, Rillieux la Pape, France

[21] Appl. No.: 725,758

[22] Filed: Jul. 3, 1991

[30] Foreign Application Priority Data

Jul. 10, 1990 [FR] France ..... 90 09396

[51] Int. Cl.[5] ..... F23Q 2/32

[52] U.S. Cl. ..... 431/129; 431/147; 431/268; 431/344

[58] Field of Search ..... 431/7, 129, 142, 144, 431/344, 347, 326, 328, 268, 147

[56] References Cited

U.S. PATENT DOCUMENTS 2,997,869 8/1961 Weiss ..... 431/268

4,235,588 11/1980 Tanaka ..... 431/268

FOREIGN PATENT DOCUMENTS 306021 12/1990 Japan ..... 431/268

8713355 6/1987 World Int. Prop. O. ..... 431/268

*Primary Examiner*—James C. Yeung

*Attorney, Agent, or Firm*—Herbert Hubno; Andrew Wilford

[57] ABSTRACT

A catalytic burner has a nozzle for forming a jet of combustible gas extending along a jet axis, a catalyst body supported offset from and immediately adjacent the axis heatable to an activation temperature at which it supports catalytic combustion, and a device like a piezoelectric crystal for igniting the jet and thereby forming at the axis a flame that heats the body. The flame is quenched after it has heated the body to its activation temperature.

13 Claims, 3 Drawing Sheets

CATALYTIC BURNER

FIELD OF THE INVENTION

The present invention relates to a catalytic burner. More particularly this invention concerns such a burner usable in a cigarette lighter or the like.

BACKGROUND OF THE INVENTION

A lighter is known from international patent application PCT/AT 86/00076 (filed by Werner Fiala based on an Austrian priority of Nov. 21, 1985) where a pilot flame is ignited by a spark in a standard manner and is used to heat a catalyst body to its activation temperature, that is a temperature sufficient for it to sustain combustion without needing the application of additional heat. The pilot flame is created in standard fashion by applying a spark to a jet of combustible gas, typically butane, that is issuing from a nozzle and that entrains oxygen-containing air by the venturi effect. This flame passes through the catalyst body and is snuffed out upstream once the activation temperature is reached, subsequent burning being autogenous. This type of burner is termed the primary-air or induced-air type.

The disadvantage of such a system is the high cost of making it and installing it, including forming a hole in the injector, positioning same coaxial with the venturi, and controlling pressure losses in the catalytic body. In addition the increased aeration created by the venturi injector system is overcome by the pressure loss caused by the catalytic body. The result is a loss of aeration that increases quickly as the catalytic body becomes clogged with soot and other combustion byproducts. This aeration can even be reduced by pulling in cigarette smoke when the burner is used in a cigarette lighter. All these changing factors make it impossible to accurately control the mixture at the burner and, hence, its reliable operation. It is therefore impossible to find a balance between sure ignition which on the one hand requires a relatively heavy flow and long life of the catalyst body which on the other hand requires minimal flow through it.

Another type of catalytic burner (see U.S. Pat. Nos. 4,189,294 and 2,997,869) uses a hydrocarbon gas with secondary air. In this type of burner the combustion air is taken by diffusion from the air around the jet of gas issuing from the nozzle. This type of burner is only operable when nothing blocks the jet of combustible gas. As a result this type of burner is only used in large devices serving to produce a large amount of heat, such as heating radiators, thermal-treatment ovens, and the like. In addition such devices are generally provided with a fairly powerful igniting system provided with its own energy source, typically an electrical resistance-type heater or a separate pilot burner. Thus this type of burner cannot be used for a small device like a cigarette lighter, curling iron, laundry iron, small space heater, or deodorizer.

OBJECTS OF THE INVENTION

It is therefore an object of the present invention to provide an improved catalytic burner.

Another object is the provision of such an improved catalytic burner which overcomes the above-given disadvantages, that is which can be made very small but that will still work very reliably.

SUMMARY OF THE INVENTION

A catalytic burner according to this invention has a nozzle for forming a jet of combustible gas extending along a jet axis, a catalyst body supported offset from and immediately adjacent the axis heatable to an activation temperature at which it supports catalytic combustion, and a device like a piezoelectric crystal for igniting the jet and thereby forming at the axis a flame that heats the body. According to the invention the flame is quenched after it has heated the body to its activation temperature.

The instant invention is based on the recognized principle that a gas mixture is harder to burn as its balance of gases varies from the stoichiometric proportion, that for a flame to be stable it is necessary to have more gas volume as its oxygen content decreases, and that conversely a flame can be made unstable by locally and/or temporarily limiting oxygen feed to the flame. Thus in the inventive type of flame using secondary air, that is where the oxygen is not drawn into the jet of combustible gas by the venturi effect but instead the combustible-gas jet is merely surrounded by oxygen-containing air, only one feed conduit for the combustible gas is needed and the catalytic body is held offset from the flame that serves to heat it to its activation temperature. Once the activation temperature is reached by at least a portion of the catalyst body, the propagation of the heating flame is stopped, that is the flame is quenched and combustion continues off the catalyst body.

More particularly according to this invention the flame is quenched by a mesh tube surrounding the axis and of sufficiently small mesh size that it quenches the flame at the axis. The catalyst body is supported on the mesh tube and the mesh tube can be cylindrical and the body can be sufficiently axially elongated that it quenches the flame by consuming oxygen once it reaches the activation temperature. Thus the flame rises in the tube and to start with burns while heating the catalyst body. Once, however, the body reaches its activation temperature it starts to oxidize the combustible gas needed to maintain the flame and this flame is snuffed out.

The tube of this invention has an end remote from the nozzle and closed by a mesh cap. More particularly the remote end of the tube is generally conical and the tube is generally cylindrical and coaxial with the jet. In this case the catalyst body is generally cylindrical and coaxial with the tube. A perforated cap can cover the mesh tube, with the body exposed at the side of the cap.

According to another feature of this invention a generally closed case carries the igniter, quencher, and the body and has a wall transverse to the axis, spaced outward from the nozzle, and formed generally aligned with the axis with a throughgoing port. Here the quencher includes means for blocking and unblocking the port. The blocking means is an element movable between a position blocking the port and a position clear of and unblocking the port. This element is displaceable between a pair of end positions and through an intermediate position. One of the end positions corresponds to the blocking position, the intermediate position corresponds to the unblocking position, and the element overlies and covers the catalyst in the other end position.

The body can be set in the wall adjacent the port or it can be set in the movable element and is movable therewith.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
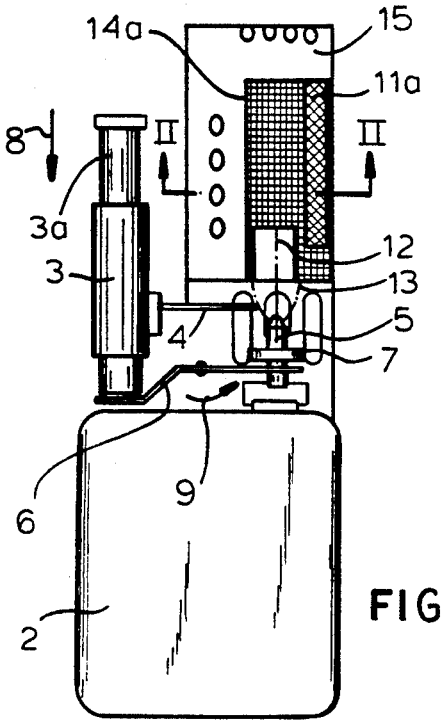
FIG. 1 is a side view partly in vertical section through a burner according to the invention.
Figure 2:
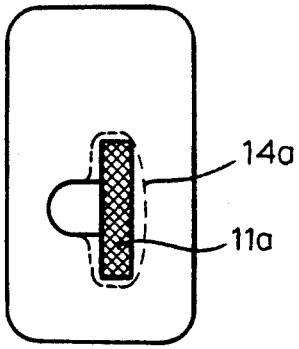
FIG. 2 is a section taken along line II—II of FIG. 1.

As seen in FIGS. 1 and 2 a burner according to this invention has a butane-filled reservoir 2 provided with a nozzle 5 that can be fed gasified butane via a valve 7 to form a jet extending along a longitudinal and here upright axis 12. A piezoelectric sparker 3 has a plunger 3*a* that can be depressed in the direction of arrow 8 to draw a spark between a fixed electrode 4 extending from the side of the crystal sparker 3 and the nozzle 5. A centrally pivoted lever 6 has one end that is engaged by the lower end of the plunger 3*a* and another end that engages under a collar of the valve 7. Thus as is standard when the plunger 3*a* is depressed the valve 7 is opened to emit the jet of combustible gas from the nozzle 5 and simultaneously a spark is drawn between the electrode 4 and the nozzle 5, igniting the jet to form a flame 13.

In accordance with this invention a T-section mesh tube 14*a* surrounds the flame 13 and holds a catalytic body 11*a* immediately adjacent this flame. This tube 14*a* is in turn surrounded by a perforated cap 15. The mesh size of the tube 14*a* is so small that it fairly quickly quenches the flame 13, but not before it has had time to lick over and heat up at least a portion of the body 11*a* sufficient to support autogenous combustion thereon as is known with oxidation catalysts.

Thus even though the flame 13 goes out shortly after the user has pressed down the plunger 3*a*, catalytic combustion will continue on the surface of the body 11*a* so long as the valve 7 is held open.

Figure 3:
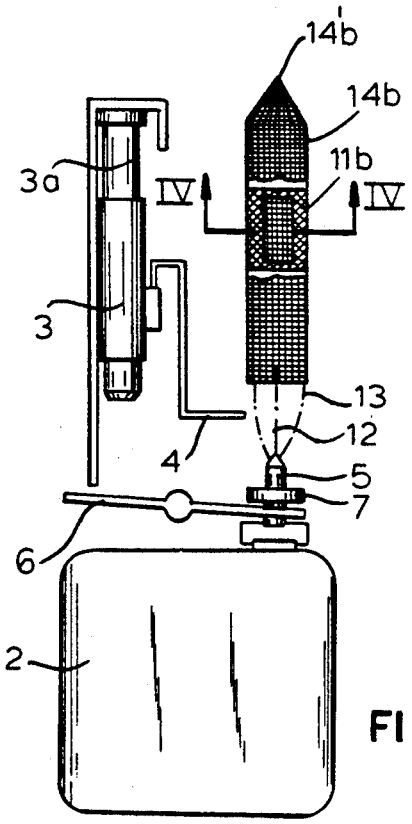
FIG. 3 is a view like FIG. 1 of a second embodiment of this invention.
Figure 4:
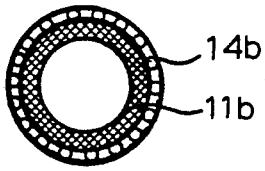
FIG. 4 is a section taken along line IV—IV of FIG. 3.

In FIGS. 3 and 4 there is a circular-section mesh tube 14*b* in which is set a cylindrically tubular catalytic body 11*b*. This tube 14*b* and body 11*b* are coaxial with the flame 13 and the tube 14*b* has a conically pointed and closed upper end 14'*b* that ensures snuffing of the flame 13 after it has sufficiently heated the body 11*b* to its activation temperature.

Figure 5:
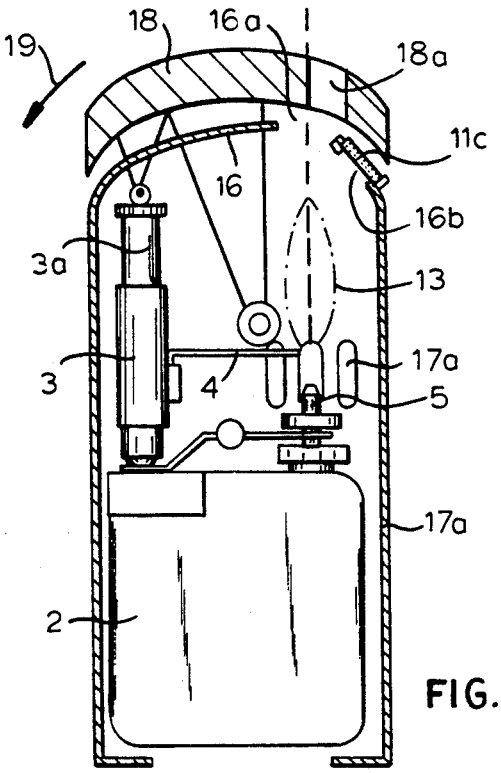
FIGS. 5, 6, and 7 are vertical sections through a third embodiment of the burner which here is incorporated in a cigarette lighter in different operational positions.
Figure 6:
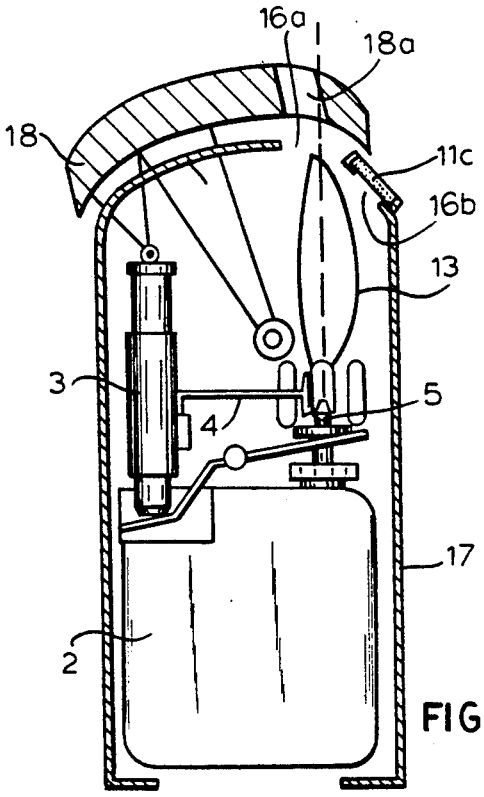
Figure 7:
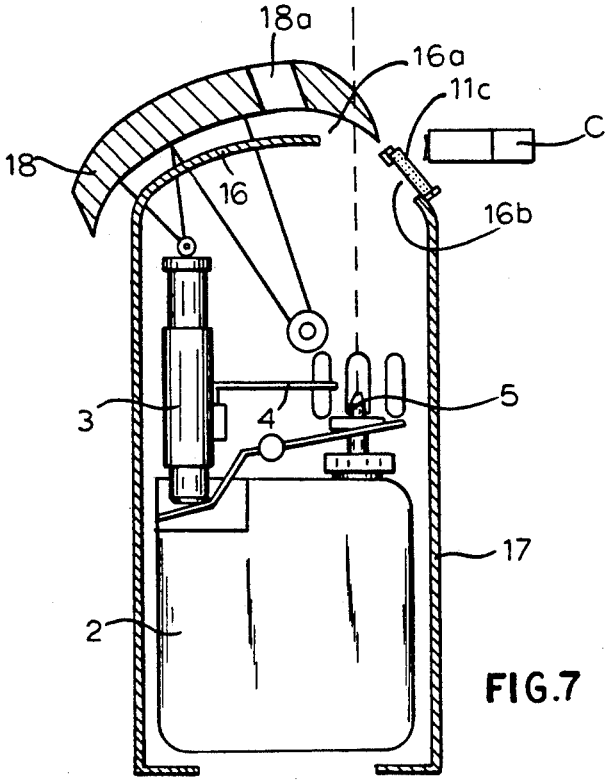

FIGS. 5 through 7 show such a burner used in a cigarette lighter and held in a metallic housing 17 having an upper wall 16 formed in line with the flame 13 with a main port 16*a*. A side wall of the housing 17 is formed with ports 17*a* allowing air to be drawn in. Laterally offset from the port 16*a* is another aperture or port 16*b* in which is set a small block 11*c* of an oxidation catalyst. A pivotal cover 18 linked to the plunger 3*a* is formed with another port 18*a* that can be aligned with the port 16*a*.

Thus when the cover 18 is pivoted back as illustrated in FIG. 6 the ports 16*a* and 18*a* are aligned and a flame 13 is ignited. This flame heats the underside of the body 11*c*. Then the cover 18 pivots further back to the position of FIG. 7, covering the port 16*a* and quenching the flame 13 so that combustion continues with gas deflected over the outer surface of the body 11*c*. A cigarette C can be touched to the glowing body 11*c* to light it.

Figure 8:
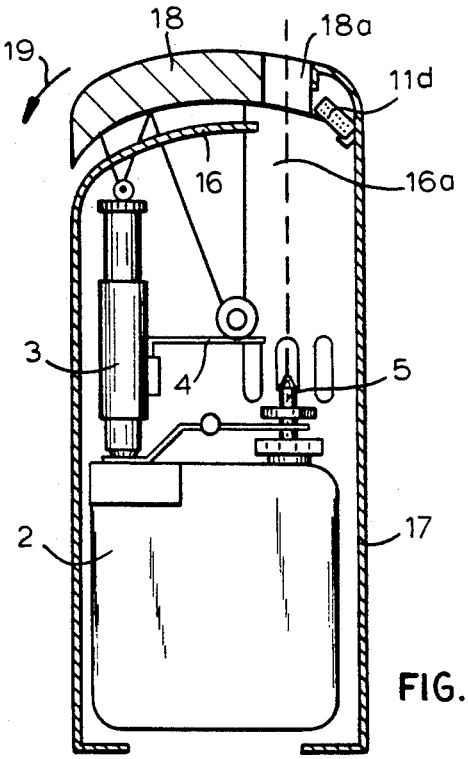
FIGS. 8, 9, and 10 are views like FIGS. 5, 6, and 7, respectively, showing a fourth embodiment of the burner in a cigarette lighter.
Figure 9:
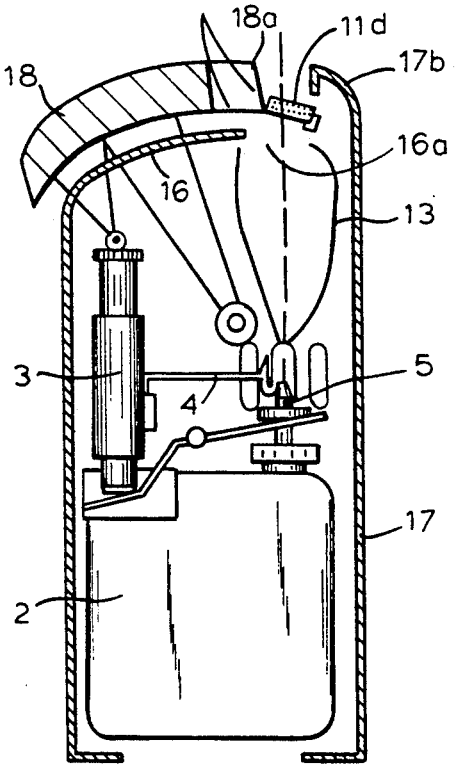
Figure 10:
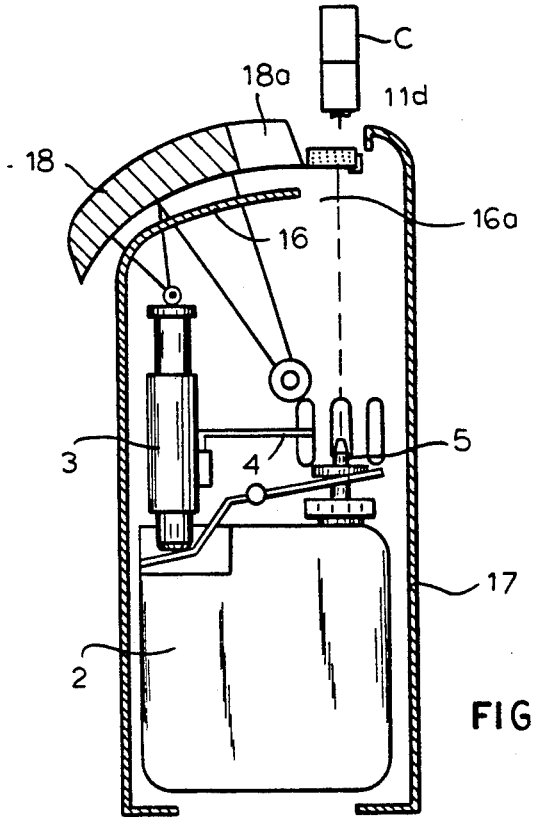

Similarly in FIGS. 8 through 9 the cover 18 carries a catalytic body 11*d* that is pulled into alignment with the flame 13 as it is snuffed. Thus as the cover is pulled back the port 18*a* is blocked by the top wall 16 and the catalyst body 11*d* is exposed underneath a lip 17*b* of the housing 17, which lip 17*b* serves to deflect the flow of gas over the surface of the body 11*d* so it continues to support combustion for lighting a cigarette C. When the cover 18 is closed the hot body 11*d* is safely slipped back under the lip 17*b* so the user can safely pocket the lighter.

We claim:

1. A catalytic burner comprising:

a housing;

means including a nozzle on the housing for forming a jet of combustible gas extending along jet axis in the housing;

a catalyst body supported on the housing offset from and immediately adjacent the axis heatable to an activation temperature at which it supports catalytic combustion;

means on the housing for igniting the jet and thereby forming at the axis a flame that heats the body; and means on the housing for quenching the flame by blocking access of sufficient oxygen to maintain the flame after the flame has heated the body to its activation temperature.

2. The catalytic burner defined in claim 1 wherein the quenching means includes a mesh tube surrounding the axis and of sufficiently small mesh size that it quenches the flame at the axis.

3. The catalytic burner defined in claim 2 wherein the catalyst body is supported on the mesh tube.

4. The catalytic burner defined in claim 3 wherein the mesh tube is cylindrical and the body is sufficiently axially elongated that it quenches the flame by consuming oxygen once it reaches the activation temperature.

5. The catalytic burner defined in claim 2 wherein the tube has an end remote from the nozzle and closed by a mesh cap.

6. The catalytic burner defined in claim 5 wherein the remote end of the tube is generally conical and the tube is generally cylindrical and coaxial with the jet, the catalyst body being generally cylindrical and coaxial with the tube.

7. The catalytic burner defined in claim 2 wherein the quenching means further includes a perforated cap covering the mesh tube.

8. The catalytic burner defined in claim 1, further comprising a generally closed case carrying the igniting means, quenching means, and the body and having a wall transverse to the axis, spaced outward from the nozzle, and formed generally aligned with the axis with a throughgoing port, the quenching means including means for blocking and unblocking the port.

9. The catalytic burner defined in claim 8 wherein the blocking means includes an element movable between a position blocking the port and a position clear of and unblocking the port.

10. The catalytic burner defined in claim 9 wherein the movable element is displaceable between a pair of end positions and through an intermediate position, one of the end positions corresponding to the blocking position, the intermediate position corresponding to the unblocking position, and the element overlying and covering the catalyst in the other end position.

11. The catalytic burner defined in claim 9 wherein the body is set in the wall adjacent the port.

12. The catalytic burner defined in claim 9 wherein the body is set in the element and is movable therewith.

13. The catalytic burner defined in claim 1 wherein the igniting means is piezoelectric.

* * * * *